US010563496B2

(12) United States Patent
Kojen et al.

(10) Patent No.: US 10,563,496 B2
(45) Date of Patent: Feb. 18, 2020

(54) COMPACT HYDROCARBON WELLSTREAM PROCESSING

(71) Applicant: EQUINOR ENERGY AS, Stavanger (NO)

(72) Inventors: Gry Pedersen Kojen, Porsgrunn (NO); Lars Henrik Gjertsen, Jonsvatnet (NO); Andrea Carolina Machado Miguens, Trondheim (NO); Arne Olav Fredheim, Trondheim (NO); Cecille Gotaas Johnsen, Trondheim (NO); Knut Arild Maråk, Trondheim (NO)

(73) Assignee: EQUINOR ENERGY AS, Stavanger (NO)

( * ) Notice: Subject to any disclaimer, the term of this patent is extended or adjusted under 35 U.S.C. 154(b) by 50 days.

(21) Appl. No.: 15/314,312

(22) PCT Filed: May 29, 2015

(86) PCT No.: PCT/EP2015/062045

§ 371 (c)(1),
(2) Date: Nov. 28, 2016

(87) PCT Pub. No.: WO2015/181386

PCT Pub. Date: Dec. 3, 2015

(65) Prior Publication Data

US 2017/0211369 A1 Jul. 27, 2017

(30) Foreign Application Priority Data

May 29, 2014 (GB) ..... 1409555.8

(51) Int. Cl.
*E21B 43/36* (2006.01)
*C10L 3/10* (2006.01)

(52) U.S. Cl.
CPC ..... *E21B 43/36* (2013.01); *C10L 3/10* (2013.01); *C10L 3/101* (2013.01); *C10L 3/103* (2013.01);

(Continued)

(58) Field of Classification Search
None
See application file for complete search history.

(56) References Cited

U.S. PATENT DOCUMENTS 5,127,231 A 7/1992 Larue et al.
5,868,005 A 2/1999 Larue et al.
(Continued)

FOREIGN PATENT DOCUMENTS

FR 2893515 5/2007
GB 2326423 12/1998
(Continued)

OTHER PUBLICATIONS

PCT International Search Report, PCT/EP2015/062045 dated Dec. 16, 2014 (3 pages).

(Continued)

*Primary Examiner* — Matthew R Buck
*Assistant Examiner* — Douglas S Wood
(74) *Attorney, Agent, or Firm* — Eversheds Sutherland (US) LLP

(57) ABSTRACT

A system for offshore hydrocarbon processing may include a host at surface level, a subsea processing plant, and an umbilical connecting the host and the subsea processing plant. The subsea processing plant may be adapted to receive a multi-phase hydrocarbon stream from a wellhead and to output at least a hydrocarbon gas-phase stream satisfying a rich gas pipeline transportation specification to a pipeline. The umbilical provides a desiccant for drying the hydrocarbon gas, as well as power and control, from the host to the subsea processing plant.

23 Claims, 3 Drawing Sheets

(52) U.S. Cl.
CPC ..... *C10L 3/104* (2013.01); *C10L 3/106* (2013.01); *C10L 2290/06* (2013.01)

(56) References Cited

U.S. PATENT DOCUMENTS

| | | | | |
|---|---|---|---|---|
| 5,988,283 | A * | 11/1999 | Gann | E21B 43/01 166/267 |
| 6,016,667 | A | 1/2000 | Doerler et al. | |
| 7,856,848 | B2 * | 12/2010 | Lu | C10L 3/10 62/623 |
| 8,262,773 | B2 * | 9/2012 | Northrop | B01D 53/0423 585/820 |
| 9,284,831 | B2 * | 3/2016 | Tomter | E21B 43/36 |
| 9,399,899 | B2 * | 7/2016 | Stoisits | C09K 8/52 |
| 9,512,700 | B2 * | 12/2016 | Becquin | F17D 3/01 |
| 2004/0168811 | A1 | 9/2004 | Shaw et al. | |
| 2006/0260468 | A1 | 11/2006 | Amin | |
| 2008/0093081 | A1 | 4/2008 | Stoisits et al. | |
| 2008/0190291 | A1 * | 8/2008 | Krehbiel | B01D 17/02 95/241 |
| 2014/0208797 | A1 * | 7/2014 | Kelley | B01D 53/0473 62/611 |
| 2017/0145803 | A1 * | 5/2017 | Yeh | B01D 53/1425 |

FOREIGN PATENT DOCUMENTS

| | | |
|---|---|---|
| GB | 2447027 | 3/2008 |
| RU | 2199375 | 2/2003 |
| WO | 2006/031335 | 3/2006 |
| WO | 2008/035090 | 3/2008 |
| WO | 2010/084323 | 7/2010 |
| WO | 2014/079515 | 11/2012 |
| WO | 2012/171554 | 12/2012 |
| WO | 2013/004275 | 1/2013 |
| WO | 2013/004276 | 1/2013 |
| WO | 2013/004277 | 1/2013 |
| WO | 2013/037012 | 3/2013 |
| WO | 2013/041143 | 3/2013 |
| WO | 2013/124336 | 8/2013 |
| WO | 2013/124339 | 8/2013 |
| WO | 2014/015892 | 1/2014 |

OTHER PUBLICATIONS

PCT International Search Report and Written Opinion, PCT/EP2015/062045, dated Dec. 9, 2015 (3 pages).
PCT International Search Report and Written Opinion, PCT/EP2012/073648, dated Sep. 19, 2013 (11 pages).
PCT International Search Report, PCT/EP2011/061147, dated Mar. 27, 2012 (4 pages).
GB Search Report, GB1409555.8, dated Dec. 16, 2014 (3 pages).

* cited by examiner

COMPACT HYDROCARBON WELLSTREAM PROCESSING

The invention concerns a method and system for subsea hydrocarbon gas treatment. The gas treatment may include dehydration, hydrocarbon dewpoint control, gas sweetening and/or mercury removal.

When hydrocarbons are produced by remote or marginal offshore oil and gas fields, they often require some processing prior to transportation. This may be achieved by means of subsea developments rather than surface platforms in order to reduce costs. The number of subsea process units are traditionally kept low and the units themselves are of reduced complexity in order to minimise maintenance and reduce the risk of malfunctions.

Accordingly, traditional subsea processing facilities only minimally process the incoming hydrocarbon-containing stream, which is then be transported as a two-phase or multi-phase mixture to a central offshore processing hub located between several oil and gas fields. Further processing of the hydrocarbons to pipeline transportation specifications is then performed utilising the processing capacity of the central offshore processing hub.

The produced hydrocarbon-containing fluid is warm when entering the wellhead, generally in the range of 60-130° C. and will, in addition to hydrocarbons, often contain liquid water and water in the gas phase corresponding to the water vapour pressure at the current temperature and pressure. Processing prior to transportation is required because, if the gas is transported untreated over long distances and allowed to cool, then the water in gas phase will condense and, below the hydrate formation temperature, hydrates will form. The hydrate formation temperature is in the range of 20-30° C. at pressures of between 100-400 bara.

Hydrates are ice-like crystalline solids composed of water and gas, and hydrate deposition on the inside wall of gas and/or oil pipelines is a severe problem in oil and gas production infrastructure. When warm hydrocarbon fluid containing water flows through a pipeline with cold walls, hydrates will precipitate and adhere to the inner walls. This will reduce the pipeline cross-sectional area, which, without proper counter measures, will lead to a loss of pressure and ultimately to a complete blockage of the pipeline or other process equipment. Transportation of gas over distance therefore normally requires hydrate control.

Existing technologies that deal with the problem of hydrate formation over short distances include:

- Mechanical scraping of the deposits from the inner pipe wall at regular intervals by pigging.
- Electric heating and insulation keeping the pipeline warm (above the hydrate appearance temperature).
- Addition of inhibitors (thermodynamic or kinetic), which prevent hydrate formation and/or deposition.

Pigging is a complex and expensive operation. It is also not well suited for subsea pipelines because the pig has to be inserted using remotely operated subsea vehicles.

Electric heating is possible subsea if the pipeline is not too long, such as of the order of 1-30 km. However, the installation and operational costs are again high. In addition, hydrate formation will occur during production stops or slowdowns, as the hydrocarbons will cool below the hydrate formation temperature.

The addition of a hydrate inhibitor, such as an alcohol (methanol or ethanol) or a glycol such as monoethylene Glycol (MEG or 1,2-ethanediol), is inexpensive and the inhibitor is simple to inject. However, if the water content is high, proportionally larger amounts of inhibitor are needed, which at the receiving end will require a hydrate inhibitor regeneration process unit with sufficient capacity to recover and recycle the inhibitor.

The above techniques may therefore be utilised for short distance transportation, for example from the wellhead to a central processing hub. However, they are not suitable for transportation over long distances, such as back to land. Hydrate control for long distance transportation is achieved by removing both the liquid water and the water in the gas phase from a produced hydrocarbon-containing fluid at the central processing hub referred to above.

The most common prior art method for achieving gas drying is by absorption, i.e. wherein water is absorbed by a suitable absorbent. The absorbent may for example be a glycol (e.g. monoethylene glycol, MEG, or triethylene glycol, TEG) or an alcohol (e.g. methanol or ethanol). However, glycols and alcohols require a low water content level to be used as an absorbent, which then requires a regeneration plant in order to remove, from the absorbent, the absorbed water.

Another common prior art method to obtain low water content in gas is by expansion and thereby cooling. This method may be performed by a valve or a (turbo) expander, where the work generated by the expanding gas may be re-used in a compressor in order to partly regain the pressure. The temperature of an expander may reach very low temperatures, such as below −25° C., and it is therefore necessary to add a hydrate/ice inhibitor to the gas before it enters the expander.

In the present specification, the term "sales gas" refers to a gas that has been treated to be meet an agreed sales gas specification, determined by a commercial sales agreement. The term "rich gas" refers to a gas that has been treated to enable transportation as a single phase and to meet the processing capabilities of the receiving terminal. The rich gas is richer in terms of heavy hydrocarbons than a sales gas, and needs further processing to satisfy sales gas specifications. Accordingly the rich gas specification is typically less strict then the sales gas specification.

In a rich gas, water and heavy hydrocarbons (e.g. $C_{3+}$) have been removed down to specified values in order to allow for single phase transport, and components such as $H_2S$, mercury and $CO_2$ have been reduced to a level acceptable by the receiving terminal. Each pipeline will have its own transportation specifications, dependent on, for example, ambient water temperature and the like.

A typical rich gas might be expected to meet at least the following specifications: a water dew point below the surrounding temperature (e.g. seabed temperature) within the operational pressure window (typically 90-250 bar), and a hydrocarbon dewpoint below seabed temperature in the pressure range 100 to 120 bar. Seabed temperatures are typically below −5° C.

By way of example, a typical rich gas pipeline transport specification (in this case for the Åsgard field) is shown below.

| Designation and unit | Specification | Notes |
|---|---|---|
| Maximum operating pressure (barg) | 210 | 1 |
| Minimum operating pressure (barg) | 112 | |
| Maximum operating temperature (° C.) | 60 | |
| Minimum operating temperature (° C.) | −10 | |
| Maximum cricondenbar pressure (barg) | 105 | |
| Maximum cricondentherm temperature (° C.) | 40 | |
| Maximum water dewpoint (° C. at 69 barg) | −18 | |
| Maximum carbon, dioxide (mole %) | 2.00 | 2, 3 |

-continued

| Designation and unit | Specification | Notes |
|---|---|---|
| Maximum hydrogen sulphide and COS (ppm vol) | 2.0 | 4, 5 |
| Maximum $O_2$ (ppm vol) | 2.0 | |
| Max. daily average methanol content (ppm vol) | 2.5 | |
| Max. peak methanol content (ppm vol) | 20 | |
| Max. daily average glycol content (litres/$MSm^3$) | 8 | |

1 Calculated at the Entry Point B1.
2 For Gas processed at Åsgard B maximum carbon dioxide is 2.30 mole %.
3 Subject to articles 4.4.1 and 4.5.1 the maximum carbon dioxide is 6.00 mole %
4 Subject to article 4.4.2 the maximum sum of hydrogen sulphide and COS is 50 ppm (vol).
5 For Gas processed at Åsgard B maximum hydrogen sulphide including COS is 2.5 ppm (vol).

Single phase transportation is preferred because three phase flow (water, liquid hydrocarbon and gaseous hydrocarbon) in a pipeline can result in a large pressure drop and imposes restrictions on the minimum flow velocity due to slugging and riser concerns. At the central processing hub, it also requires extensive separation and treatment. In particular, the gas treatment takes up much space on a topside platform or FPSO (floating production storage and offloading facility). The treatment of three phase gas at the receiving facility can also be a safety concern.

For smaller fields located remotely, it would therefore be desirable to route the gas from many fields to one common process facility, preferably located on land. It is therefore desirable to achieve the bulk separation of oil and gas at the wellhead by moving the first processing to the seabed, enabling routing the gas to one location and the liquids to another, both locations being remotely located and preferably on land. However, in order for this to be achieved it is necessary for the gas phase to satisfy minimum subsea transport specifications with respect to water content, i.e. to meet the rich gas specifications.

Some recent developments relating to this objective include a separator arrangement at the seabed to separate bulk water, and the liquid and gas phases, see for example WO 2013/004275 A1. The bulk water extracted from the input stream is re-injected into the wellhead. A hydrate inhibitor is injected into the gas phase to allow it to be cooled below the hydrate formation temperature, and gaseous water is then condensed from the gas phase by cooling. A mixture of the hydrate inhibitor and the condensed water are then separated from the gas phase and injected into the liquid-phase stream to provide a hydrate inhibition effect in the liquid-phase stream. By this arrangement, up to 97% of the water can be removed from the gas-phase stream.

This arrangement considerably reduces the need for inhibitor in the liquid and gas phases to prevent hydrates in the pipeline to the central hub. However, it does not dry the gas stream to the levels required for rich gas that can be sent directly to a pipeline.

The present invention provides a system for offshore hydrocarbon processing, comprising: a host at surface level; a subsea processing plant, the plant being adapted to receive a hydrocarbon stream from a wellhead and to output a hydrocarbon gas stream satisfying a rich gas pipeline transportation specification to a pipeline; and an umbilical connecting the host and the subsea processing plant, the umbilical being adapted to provide one or more desiccant(s) from the host to the subsea processing plant.

The present invention also provides a subsea method of offshore hydrocarbon processing, comprising: receiving, in a subsea processing plant, an input hydrocarbon stream from a wellhead; receiving, in the subsea processing plant via an umbilical, a desiccant from a host at surface level; separating, in the subsea processing plant, a hydrocarbon gas-phase stream from the input hydrocarbon stream; treating, in the subsea processing plant, the hydrocarbon gas-phase stream using the desiccant to satisfying a rich gas pipeline transportation specification; and outputting the hydrocarbon gas-phase from the subsea processing plant to a pipeline.

Thus, by means of the present invention, a subsea processing plant at the wellhead is able to output a rich gas satisfying transport properties, e.g. via a conduit containing only the rich gas. This is a significant departure from known systems in which processing on the seabed has been kept to a minimum.

Traditional subsea processing facilities have previously only marginally processed the incoming hydrocarbon stream and the hydrocarbon gas would have been transported in a two-phase or multi-phase region. By treating the gas subsea, the hydrocarbon gas can be transported as a single-phase, thereby avoiding multiphase flow concerns such as hydrate formation, slugging (and the need for slug handling systems) and minimum flow restrictions. The level of gas treating should target a specific gas transport system specification, i.e. at least to rich gas specifications, and optionally sales gas specifications (it is noted that a sales gas will also meet rich gas specifications).

The present invention allows production of rich gas which can be transported long distances in single phase pipelines before further treatment or sale. It removes the current need for additional measures for long distance transport of gas not meeting the rich gas transportation specifications, such as heating, the addition of further hydrate inhibitor, insulation of the pipeline or pigging. Furthermore, the gas does not need to be brought to the same location as any other products, such as those forming the liquid phase.

Yet further in accordance with the present invention, the gas phase need never be transported to the surface host or other offshore processing plant, but rather can be sent directly to a subsea pipeline transporting it, for example, back to land. Thus, there is a savings in processing equipment and deck space at the host. Furthermore, the much smaller gas treatment facility at the host also reduces operational risk; gas treatment is often regarded as a high risk on an FPSO.

This arrangement also provides a number of further benefits, including:

- Increased gas production by enabling new tie-in projects (if there is a limitation in top-side gas treating capacity and/or top-side weight);
- Limitation of topside modifications when doing tie-in to existing facilities by avoid taking the bulk gas stream topside;
- Reduced topside weight by adding parallel process capacity subsea;
- Debottlenecking possible limitations in topside processing capacity by adding parallel process capacity subsea;
- Increasing flexibility where utilities (glycol, power, control) and different products (condensate/oil, water and gas) are utilizing different locations; and
- Increasing tie-back range where gas and liquids are transported as separate single phase products reducing pressure drop and avoiding minimum flow restrictions.

Preferably the hydrocarbon gas-phase stream is output from the subsea processing unit to a rich gas pipeline without further processing. That is to say, the subsea processing plant completes all of the processing steps required to output the gas to a subsea pipeline. Further processing should be understood as including any process that substantially alters the composition of the hydrocarbon gas stream, and does not include, for example, booster compressors or the like.

The desiccant may be an absorbent, preferably further having the capability to reduce the acid and sour gas content of the hydrocarbon gas stream sufficiently low so as to enable the subsea processing plant to satisfy rich gas pipeline transport specifications. However, this may not be required in all pipelines.

The host preferably further supplies power and/or control to the subsea processing plant, for example via the umbilical. This allows for the power and control systems to be located on the host, where they can be readily accesses for maintenance or repair. It further allows control of the subsea processing plant from the surface, without the actual processing units needing to be located at the host.

Thus, the operation of the subsea processing plant may be controlled by the host, preferably via the umbilical. The host may control the hydrocarbon dew point and the water dew point of the hydrocarbon gas stream output by the subsea processing plant, and/or the content of $H_2S$, $CO_2$ and Hg of the hydrocarbon gas stream output by the subsea processing plant.

The subsea processing plant may also separate a hydrocarbon liquid-phase stream from the input hydrocarbon stream.

In some embodiments, the desiccant may include a hydrate inhibitor having a water content sufficiently low so as to enable the subsea processing plant to dry the hydrocarbon gas stream using the hydrate inhibitor so as to satisfy rich gas pipeline transport specifications.

After treating the hydrocarbon gas stream using the desiccant (i.e. the hydrate inhibitor), the desiccant may then be mixed with the liquid-phase hydrocarbon stream. This allows the liquid hydrocarbons to then be transported over long distances, allowing the desiccant to serve a dual function as both a desiccant (for the gas phase) and a hydrate inhibitor (for the liquid phase).

Of course, the desiccant need not be mixed with the liquid-phase hydrocarbon stream after being used to treat the hydrocarbon gas-phase stream. It may then be returned to the host, for recycling, for example to be reused in the subsea processing plant.

The subsea processing plant is adapted to receive a hydrocarbon stream from a wellhead and to output a hydrocarbon gas stream satisfying a rich gas pipeline transportation specification to a pipeline. To achieve this, in a preferred embodiment, the subsea processing plant may comprise: an input conduit for receiving a multi-phase input stream from a wellhead; a first separator fed by the input conduit for separating a hydrocarbon gas-phase stream from the multi-phase input stream and for outputting the hydrocarbon gas-phase stream to an intermediate conduit; an injector for supplying desiccant to the intermediate conduit to dry the hydrocarbon gas stream so as to meet a rich gas pipeline transportation specification; and a second separator fed by the intermediate conduit for separating the desiccant from the hydrocarbon gas phase stream, and for outputting the hydrocarbon gas-phase stream to a first output conduit and the desiccant to a second output conduit.

The first output conduit thus contains only the hydrocarbon gas-phase stream satisfying the rich gas pipeline transport specification. That is to say, it could be injected directly into a rich gas pipeline with no further processing.

Thus, preferably, the first output conduit may feed the hydrocarbon gas-phase stream to a rich gas pipeline without the hydrocarbon gas-phase stream being taken above sea level.

The host may be a platform at surface level and having a store of desiccant. and the umbilical may comprise a umbilical line adapted supply the desiccant from the store of desiccant of the host to the injector of the subsea processing plant.

The first separator may further be arranged to output a liquid-phase hydrocarbon stream to a second intermediate conduit. The second intermediate conduit may either feed the liquid-phase hydrocarbon stream into the second output conduit to be mixed with the desiccant, or may feed the liquid-phase hydrocarbon stream to a third output conduit, separate from the first and second output conduits.

The processing plant may comprise a cooler in the first intermediate conduit, preferably downstream of the injector, for cooling the hydrocarbon gas-phase stream. The cooler acts to "knock out" gaseous water contained in the stream.

In some embodiments, the processing plant may comprising a cooler followed by a separator in the first intermediate conduit upstream of the injector, to "knock out" water and heavy hydrocarbons contained in the hydrocarbon gas-phase stream before injection of the desiccant. This reduces the quantity of desiccant required.

The host may comprise a desiccant regenerator, and wherein the umbilical line is further adapted to transport the desiccant from the second output of the subsea processing plant to the desiccant regenerator of the host.

The umbilical line is preferably adapted to supply power and/or control signals from the host to one or more components of the subsea processing plant.

The subsea processing plant may also comprise one or more of an $H_2S$ remover, a $CO_2$ remover and/or an Hg remover, arranged in the intermediate conduit or the first output conduit to process the hydrocarbon gas-phase stream output.

Certain preferred embodiments of the present invention will now be discussed in greater detail, by way of example only, and with reference to the accompanying drawings, in which.

In the following, it is of importance to understand certain differences between the terms "water removal" and "gas drying".

"Water removal" means removing a bulk amount of water from a stream and does not result in a dry gas per se.

"Gas drying" concerns the dehydration of a gas in order to satisfy a water content specification of a pipeline for transport (i.e. rich gas). Such specifications vary from pipeline to pipeline. In one typical pipeline, a water dew point of −18° C. at 70 bar is specified. In European sales gas pipelines, a water dew point of −8° C. at 70 bar is specified. This corresponds to a water content from around 80 ppm to 30 ppm, but the specification can also be outside this range. In general, a water dew point below the sea water temperature at 70 bar is typically the minimum requirement. One preferred embodiment sets a minimum requirement for the water dew point of 0° C. at 70 bar, which corresponds to a water content of around 120 ppm. An alternative preferred requirement is a water dew point of −8° C. at 70 bar.

"Water knock-out" is the removal of water by condensation.

"Gas dehydration" is the process of water removal beyond what is possible by condensation and phase separation.

Figure 1:
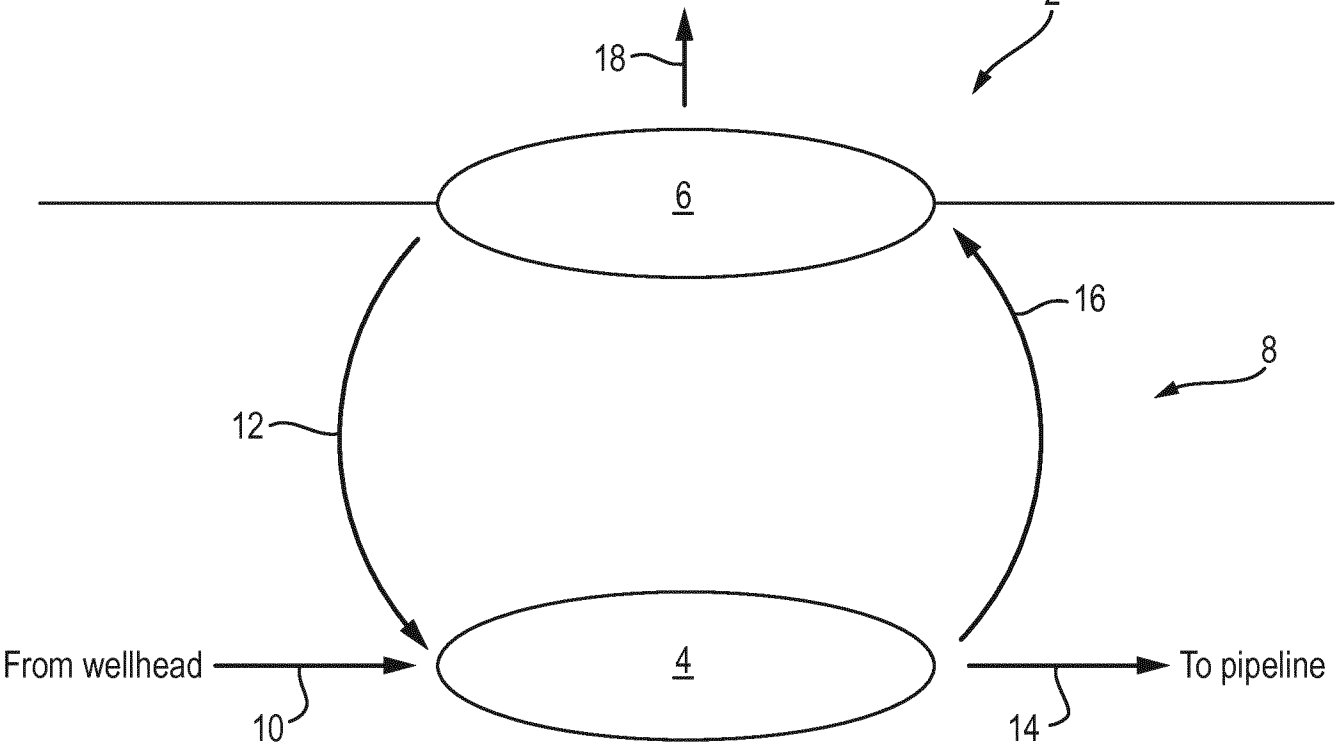
FIG. 1 is a schematic drawing showing a surface host and a subsea processing plant in accordance with the present invention.

FIG. 1 shows an overview of a system 2 for subsea gas processing in accordance with the present invention.

The system 2 includes a subsea processing plant 4 for gas processing, and a surface host 6 in communication with the subsea processing plant 4 via an umbilical 8. The subsea processing plant 4 is located on or near the seabed and the surface host 6 is located at or near sea level.

The subsea processing plant 4 receives, as a first input 10, a hydrocarbon stream from a wellhead (not shown). The processing plant 4 is preferably located within a relatively short distance (for example less than 500 meters) from the wellhead to avoid cooling of the unprocessed hydrocarbon stream from the wellhead when transported to the processing plant 4, which could result in hydrate formation before the stream is processed. If the processing plant is located further away from the wellheads, then some initial processing (e.g. injection of a hydrate inhibitor) may be required as will be discussed below, unless there is only a small amount of free water at the wellhead.

The subsea processing plant 4 further receives, as a second input 12, an desiccant from the surface host 6 via the umbilical 8. The desiccant should be of the type suitable for dehydrating a hydrocarbon gas stream to meet the water dew point requirements of the relevant rich gas transportation specification. Examples include lean glycols (such as TEG, MEG, DEG, TREG, etc.) and alcohols (such as methanol or ethanol), which have a water content below 5 wt. % (preferably below 2 wt. % and most preferably below about 1 wt. %).

The desiccant is preferably also an absorbent having the capability to reduce the acid and sour gas content of hydrocarbon gas. In the preferred implementation, the desiccant is a lean MEG mixture containing below 2 wt. % water.

The subsea processing plant 4 also receives power and control signals from the surface host 6 via the umbilical 8. The control signals may control, for example, a target water dew point and a target hydrocarbon dew point of an output gas. It may also control the target $H_2S$, $CO_2$ and Hg content of the output gas, which may be part of the rich gas transport specification.

The subsea processing plant 4 outputs, as a first output 14, a gas phase hydrocarbon stream that meets a respective rich gas pipeline transport specification. For example, if the wellhead were in the Åsgard field, the respective rich gas transport specification would be the example given above.

The subsea processing plant 4 also outputs wet desiccant (e.g. rich glycol having a water content above 10%), liquid phase hydrocarbon stream including condensed hydrocarbons, and water. These outputs may be sent to various locations for further processing, but in the present embodiment these are output via the umbilical 8 to the surface host 6 as a second output 16. The second output 16 may comprise a single, mixed stream, or may alternatively comprise two or more separate streams, as will be apparent from the following descriptions.

The liquid phase hydrocarbons are separated from the second output 16 and are further processed at the host 6 before being output as a host output 18 to a liquid-phase hydrocarbon pipeline.

Figure 2A:
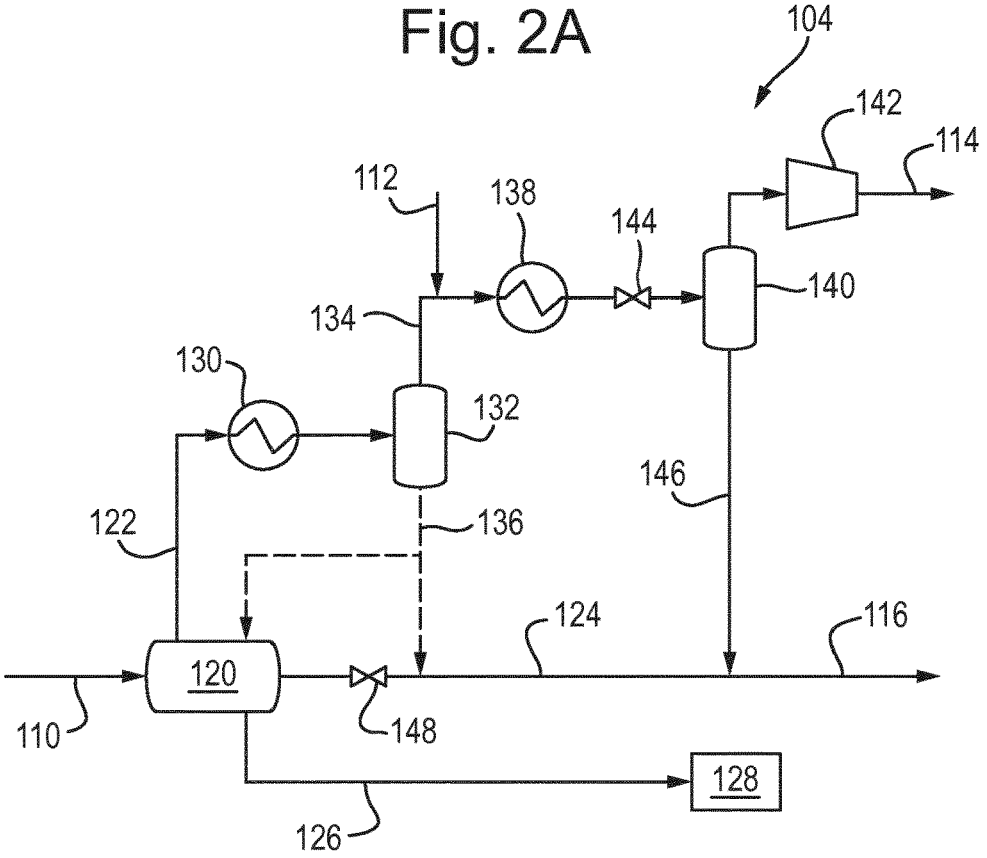
FIGS. 2A and 2B show schematic diagrams a subsea separation processing plant and a corresponding surface host, respectively, in accordance with a first embodiment of the present invention.
Figure 2B:
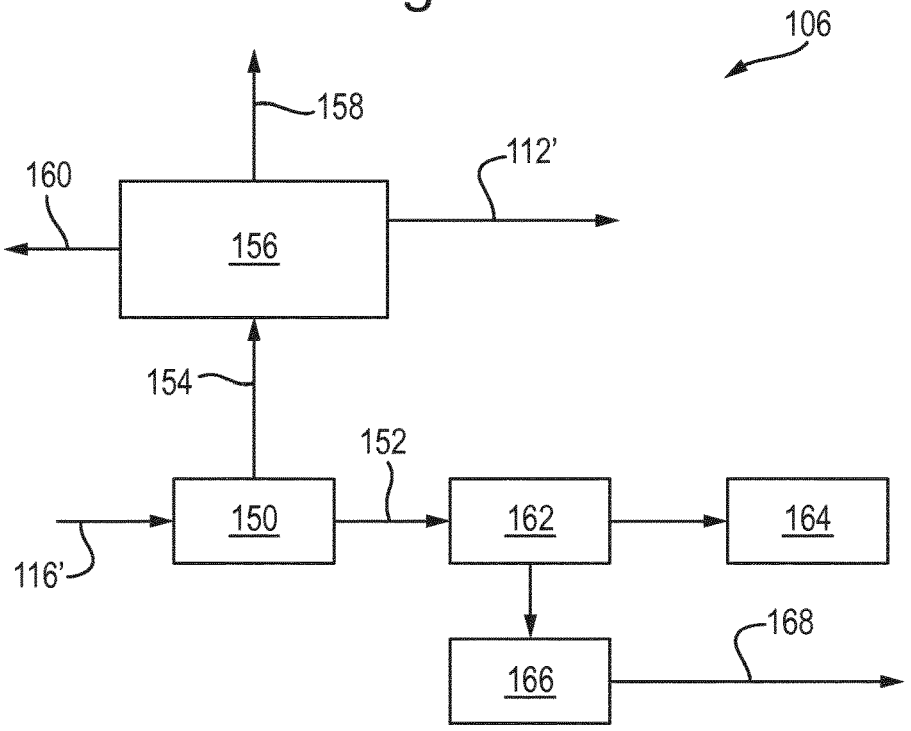

FIG. 2A shows a schematic view of a subsea processing plant 104 for gas dehydration, water dew point depression and water removal according to a first embodiment the present invention. FIG. 2B shows a corresponding surface host 106 for desiccant regeneration and liquid phase hydrocarbon processing according to the first embodiment of the present invention.

In the first embodiment, the surface host 106 processes a common return stream from the subsea processing plant 104 containing a mixture of liquid phase hydrocarbon, water and desiccant.

Features that correspond to those shown in the FIG. 1 overview have been labelled, in this embodiment, with corresponding reference signs incremented by 100.

In the subsea processing plant 104, a multiphase hydrocarbon-containing well stream is received via a pipeline 110. The well stream is separated by a first, three-phase separator 120 into: a hydrocarbon gas phase that is output via a first gas-phase conduit 122; a hydrocarbon liquid phase that is output via a first liquid-phase conduit 124; and a liquid water phase that is output via a water-phase conduit 126.

The separated liquid water phase in water-phase conduit 126, in this embodiment, is re-injected in sub terrain formations via a wellhead 128.

The gas in first gas-phase conduit 122 is cooled to a temperature above the hydrate formation temperature in a first multiphase gas cooler 130 to knock out vaporised water and heavy hydrocarbons. The cooled flow is then passed from the cooler 130 to a second separator 132 where the gas and liquid phases are separated into a gas phase exiting the separator 132 via a second gas-phase conduit 134 and a liquid phase exiting the separator 132 via a second liquid-phase conduit 136. The liquid in the second liquid-phase conduit 136 may, in one arrangement, be connected to the first liquid-phase conduit 124 containing the bulk liquid phase from the first separator 120, or may, in an alternative arrangement, be connected back into the first three-phase separator 120, for example to reduce the amount of water in the liquid phase in conduit 124 and hence reducing the risk of hydrate formation.

A desiccant hydrate inhibitor, supplied from the host 106, is added to the gas in the second gas conduit 134 via an inlet 112 (e.g. an injection inlet). This hydrate inhibitor must have a water content that is low enough to enable it to dry the gas so that the gas phase output from the subsea processing plant 104 is able to satisfy subsea transport specifications, e.g. MEG comprising less than 2 wt. % water, preferably less than 1 wt. % water and most preferably 0.3 wt % water or less. It is also important that the hydrate inhibitor and gas phase are well mixed, something which might take place in a mixing unit (not shown). The rate at which desiccant is injected via inlet 212 controls the water dew point of the hydrocarbon gas output by the subsea processing plant 104.

After the desiccant hydrate inhibitor has been injected, the gas in the second gas-phase conduit 134 is then fed to a second multiphase gas cooler 138. The hydrate inhibitor prevents hydrates forming in the second cooler 138. The gas exits the second cooler 138 via a conduit equipped with a choke valve 144. The choke valve 144 enables regulation of the expansion of the gas phase and thereby cooling of said phase down below the sea water temperature due to the Joule Thomson or Joule-Kelvin effect. The choke valve 144 is controlled based on the control signal received from the host 106.

The cooled gas is separated from any condensates and liquid water in a third separator 140 and a very dry gas phase that is able to satisfy subsea transport specifications exits the separator 140. This dry hydrocarbon gas phase may optionally be compressed by an export compressor 142 before being routed to a gas pipeline via a first plant output conduit 114.

It is important that the separator 140 be very efficient, i.e. it can take out as much inhibitor from the gas as possible, preferably such that it is able to remove at least 99%, preferably at least 99.5% and most preferably 99.9% of the liquid phase entering separator 140.

The condensed liquids from the third separator 140, which include the hydrate inhibitor injected via the injector 112, leave via conduit 146 and are mixed with the bulk liquid phase in conduit 124 from the first separator 120, which contains very little water when the condensates including water from the first separator 132 are recycled into the first three-phase separator 132. The bulk liquid phase is pumped via a second plant outlet 116 to the host 106.

A regulating valve 148 on the bulk liquid conduit 124 upstream of the mixing point with conduit 146 (and conduit 136 if applicable) may be present, in order to prevent flashback into the first separator 120 and/or to regulate the mixing rate and composition of the liquid streams. This is controlled by the control signal from the host 106. As the combined liquid phase is warm, contains little water and contains hydrate inhibitor (that was originally injected into the second gas phase), this combined liquid phase may as a result be transported over long distances without hydrate formation occurring. Thus, in an alternative arrangement, instead of being pumped to the host 106 the second plant outlet 116 may be pumped to a remote location without the need to be pumped topside.

The inhibitor injected via injector 112 is thus used both for dehydration of the hydrocarbon gas phase, and subsequently is further used as hydrate inhibitor for the water in the liquid hydrocarbon phase. The amount and quality of the inhibitor can be adapted to fit both purposes, which is regulated by the host 106. This enables the production of a very dry gas from the first plant output 114 which is able to satisfy subsea transport specifications which can thus be transported long distances via a single phase gas pipeline to a gas treatment plant, without the need to be transported topside, as well as the production of an inhibited liquid hydrocarbon phase from the second plant output 116, which contains only a small amount of water in a single phase pipeline. The liquid hydrocarbon phase, including the hydrate inhibitor, can safely be transported to another destination, e.g. to a nearby oil hub, or pumped up to the host 106. The hydrated inhibitor is then regenerated.

The host 106 receives, as a first host input 116', a mixed liquid phase containing liquid phase hydrocarbons, produced water and the hydrate inhibitor, which is received from the second plant output 116 of the subsea plant.

The mixed liquid phase is passed to a first separator 150. The first separator 150 separates the mixed phase flow into a liquid phase hydrocarbon flow, which is output via a liquid hydrocarbon conduit 152, and a hydrate inhibitor flow containing the produced water, which is output via a hydrate inhibitor regeneration conduit 154.

The hydrate inhibitor regeneration conduit 154 connects to a regeneration unit 156 in which the hydrate inhibitor is regenerated. The water is condensed and disposed of at 158, and the regenerated hydrate inhibitor is pumped back to the subsea processing plant 104 as a first host output 112' to the injector 112 of the plant 104. If the bulk water separated in the plant 104 is not re-injected into the wellhead, the produced water may also contain large quantities of salts which must also be separate and disposed of at 160.

The liquid hydrocarbon conduit 152 from the first separator 150 is fed to a condensate stabiliser 162 and stabilised liquid hydrocarbon is sent for storage or offloading at 164. Some gaseous hydrocarbons form during stabilisation and the gas is used pumped to a power generator 166 to provide power to the host 106 and to the subsea processing plant 104 as a second host output 168.

Figure 3A:
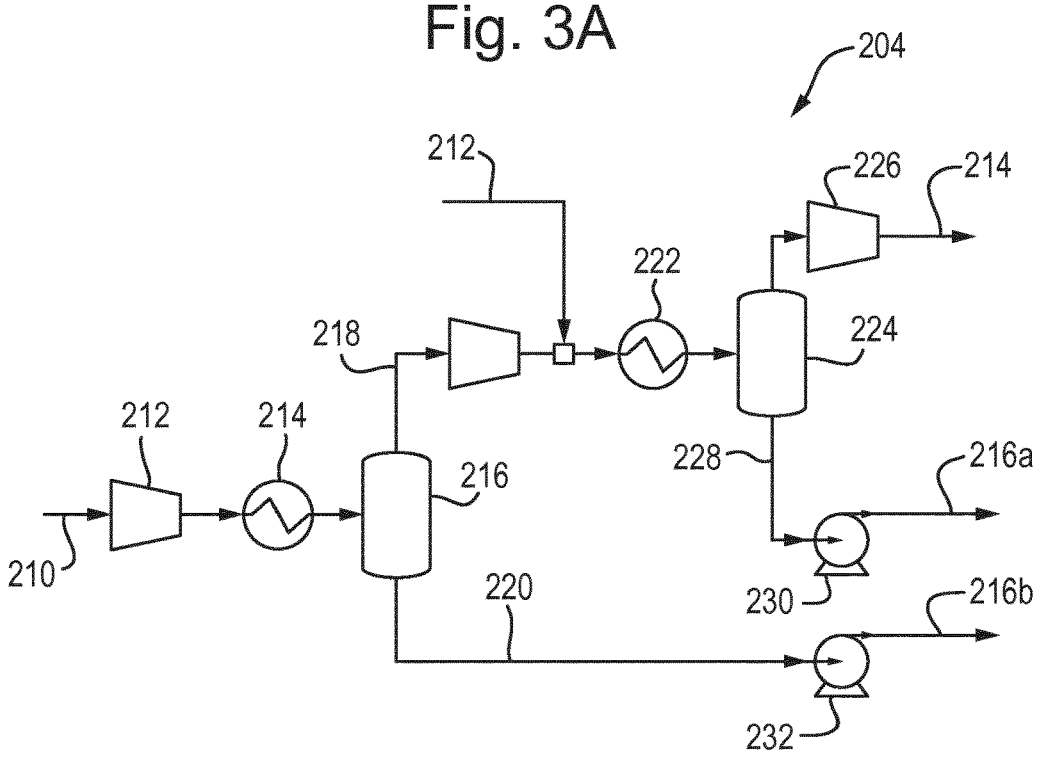
FIGS. 3A and 3B show schematic diagrams a subsea separation processing plant and a corresponding surface host, respectively, in accordance with an alternative second embodiment of the present invention.
Figure 3B:
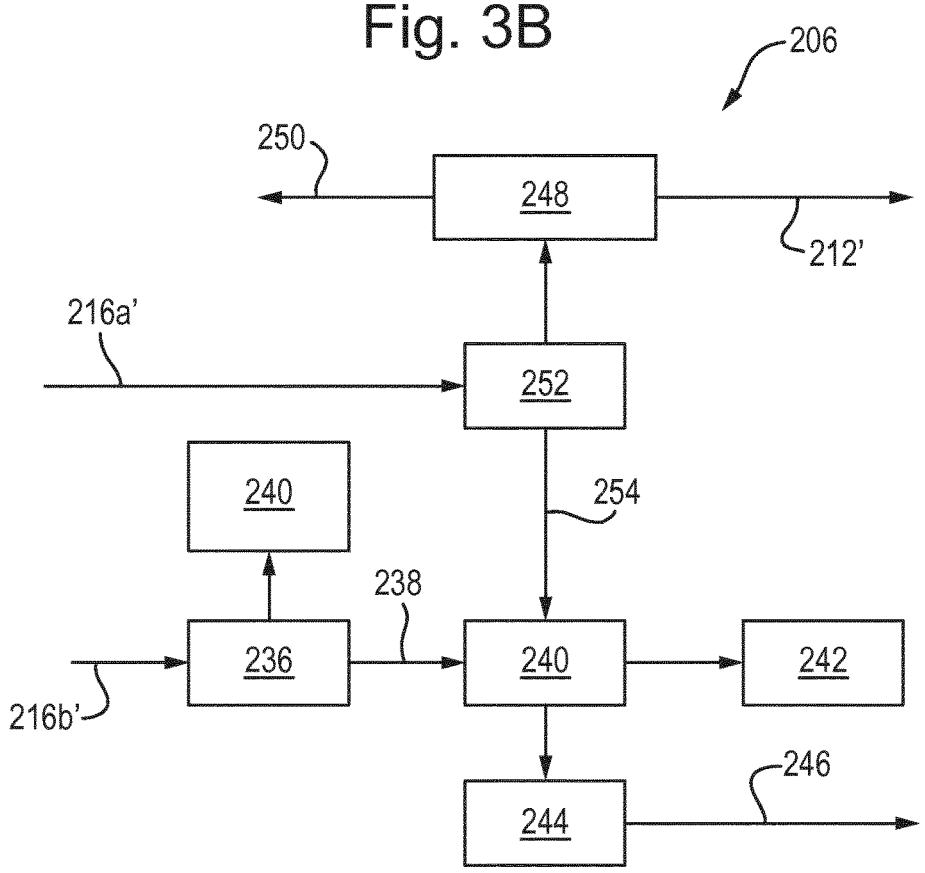

FIG. 3A shows a schematic view of a subsea processing plant 204 for gas dehydration, water dew point depression and water removal according to a second embodiment the present invention. FIG. 3B shows a corresponding surface host 206 for desiccant regeneration and liquid phase hydrocarbon processing according to the first embodiment of the present invention.

In the second embodiment, the surface host 206 processes two return streams from the subsea processing plant 204, one containing liquid phase hydrocarbon and the other containing water and desiccant.

Features that correspond to those shown in the FIG. 1 overview have been labelled, in this embodiment, with corresponding reference signs incremented by 200.

In the subsea processing plant 204, a multiphase hydrocarbon-containing well stream is received via a pipeline 210. Fluid from several wells may be mixed by a smart manifold system (not shown) and optionally pre-compressed by a compressor 212.

This alternative embodiment is particularly suitable for well streams with a lower oil and water content and where the water content in the stream from the wellhead is too low to justify an initial oil/water separation stage (i.e. using separator 120) as described with reference to FIG. 2A. However, it will be apparent to those skilled in the art that such a separation stage could be included upstream of the first cooler 214 of this embodiment, if required.

The combined well stream is cooled to a temperature above the hydrate formation temperature in a first multiphase gas cooler 214 to knock out vaporised water and heavy hydrocarbons. The flow is then passed from the cooler 214 to a first separator 216 where the gas and liquid phases are separated into a gas phase exiting the separator 216 via a first gas-phase conduit 218 and a liquid phase containing condensed water and hydrocarbon condensate via a first liquid-phase conduit 220.

A desiccant hydrate inhibitor, supplied from the host 206, is added to the gas in the first gas conduit 218 via an inlet 212 (e.g. an injection inlet). This hydrate inhibitor must have a water content that is low enough to enable it to dry the gas so that the gas phase output from the subsea processing plant 204 is able to satisfy subsea transport specifications, e.g. MEG comprising less than 2 wt. % water, preferably less than 1 wt. % water and most preferably 0.3 wt % water or less. It is also important that the hydrate inhibitor and gas phase are well mixed, something which might take place in a mixing unit (not shown). The rate at which desiccant is injected via inlet 212 controls the water dew point of the hydrocarbon gas output by the subsea processing plant 204.

After the desiccant hydrate inhibitor has been injected, the gas in the first gas-phase conduit 218 is then fed to a second multiphase gas cooler 222. The hydrate inhibitor prevents hydrates forming in the second cooler 138. As described above, the gas may exit the second cooler 222 via a conduit equipped with a choke valve (not shown in this embodiment) controlled based on the control signal received from the host 206, to enables regulation of the expansion of the gas phase.

The cooled gas is separated from any hydrocarbon condensate and liquid water in a second separator 224 and a very dry gas phase that is able to satisfy subsea transport specifications exits the separator 224. This dry hydrocarbon gas phase may optionally be compressed by an export compressor 226 before being routed to a gas pipeline via a first plant output conduit 214.

As above, it is important that the second separator 224 be very efficient, i.e. it can take out as much inhibitor from the gas as possible, preferably such that it is able to remove at least 99%, preferably at least 99.5% and most preferably 99.9% of the liquid phase entering the second separator 224.

The condensed liquids from the second separator 224, which include the hydrate inhibitor injected via the injector 212, leave in a second liquid conduit 228. In this embodiment, this separated hydrate inhibitor flow is not mixed with the bulk liquid phase in the first liquid phase conduit 220 separated by the first separator 120.

A first pump 230 pumps the hydrate inhibitor, including the extracted water, in the second liquid phase conduit 228 via a second plant outlet 216*a* to the host 206. A second pump 232 pumps the bulk liquid phase containing the water and liquid phase hydrocarbons in the first liquid phase conduit 220 via a third plant outlet 216*a* to the host 206. The pumps are controlled by the control signal from the surface host 206.

The host 206 receives, as a first host input 216*a*', a first liquid phase containing the hydrate inhibitor containing extracted water, which is received from the second plant output 216*a* of the subsea plant. The hydrate inhibitor flow may also contain small amounts of condensed hydrocarbon. Where the hydrate inhibitor is a glycol, this glycol/water mixture is often referred to as rich glycol.

The first liquid phase is passed to a first separator 252. The first separator 252 separates any condensed hydrocarbons and passes them, via a condensed hydrocarbon conduit 254, to be processed as discussed below. The separated hydrate inhibitor flow is passed to a desiccant regeneration unit 248 in which the hydrate inhibitor is regenerated. The water is condensed and disposed of at 250, and the regenerated hydrate inhibitor is pumped back to the subsea processing plant 204 as a first host output 212' to the injector 212 of the subsea processing plant 204.

The host 206 receives, as a second host input 216*b*', a second liquid phase containing liquid phase hydrocarbons and water, which is received from the third plant output 216*b* of the subsea plant.

The second liquid phase is passed to a second separator 236. The second separator 236 separates the mixed phase flow into a liquid phase hydrocarbon flow, which is output via a liquid hydrocarbon conduit 238, and a water flow, which is sent to treatment unit 240 for treatment and disposal.

The condensed hydrocarbon conduit 254 from the first separator 252 and the liquid hydrocarbon conduit 238 from the second separator 236 feed to a condensate stabiliser 240 and stabilised liquid hydrocarbon is sent for storage or offloading at 242. Gaseous hydrocarbons formed during the stabilisation is pumped to a power generator 244 to provide power to the host 206 and to the subsea processing plant 204 as a second host output 168.

In a permutation of the subsea processing unit 204 of second embodiment, the rich hydrate inhibitor (i.e. including extracted water) from the first pump 230 may be pumped towards the wellheads and injected into the unprocessed multi-phase hydrocarbon stream from the wellhead, which is received via the input pipeline 210. The use of a hydrate inhibitor allows the wellhead stream to be pumped over longer distances without hydrates forming, allowing the subsea processing plant 204 to be further from the wellhead. The hydrate inhibitor will then be separated in the first separator 216 and pumped via the second pump 232 back to the host 206 to be recycled in the third output stream 216*b*.

In this permutation, the third output stream 216*b* contains a mixture of water, liquid-phase hydrocarbons and hydrate inhibitor; thus, a host similar to the host 106 shown in the first embodiment should be used.

Furthermore, in both the first and second embodiments, the subsea processing plant 104, 204 may optionally further include one or more of a $H_2S$ removal unit, a $CO_2$ removal unit and an Hg removal unit. The appropriate units may be included depending on the output of the wellhead and the pipeline requirements. These units should be arranged to process the dry, gas-phase hydrocarbon stream, are preferably located after respective export compressor 142, 226.

Although certain preferred embodiments of the present invention have been described, those skilled in the art will appreciate that certain modification may be made to the disclosed embodiments without departing from the scope of the invention as set forth in the appended claims.

For example, in an alternative to the second embodiments, the hydrate inhibitor may be pumped on to a further subsea processing plant after being output from the second plant output 216*a*. This may be useful where the hydrate has excess desiccant capacity. After being utilised in one of more subsequent subsea processing plants, it might then be returned to the host 206 for recycling or injected into a liquid hydrocarbon output as in the first embodiment.

The invention claimed is:

1. A system for offshore hydrocarbon processing, comprising:

a host at surface level;

a subsea processing plant, the processing plant being adapted to receive an input hydrocarbon stream from a wellhead and to output a hydrocarbon gas stream, satisfying a rich gas pipeline transportation specification, to a pipeline; and an umbilical connecting the host and the subsea processing plant, the umbilical being adapted to provide a desiccant from the host to the subsea processing plant;

wherein the desiccant is also a hydrate inhibitor; and wherein the subsea processing plant is configured to co-currently mix the desiccant with the hydrocarbon gas-phase stream, cool the mixed desiccant and hydrocarbon gas-phase stream, and separate the desiccant and condensed liquids from the hydrocarbon gas-phase stream.

2. A system according to claim 1, wherein the subsea processing plant is adapted so as not to direct the hydrocarbon gas stream to the host.

3. A system according to claim 1, wherein the host is adapted to control the hydrocarbon dew point and the water dew point of the hydrocarbon gas stream output by the subsea processing plant.

4. A system according to claim 1, wherein the host is adapted to control the content of $H_2S$, $CO_2$ and/or Hg of the hydrocarbon gas stream output by the subsea processing plant.

5. A system according to claim 1, wherein the subsea processing plant is further adapted to output a liquid stream containing liquid phase hydrocarbons separated from the input hydrocarbon stream, and wherein subsea processing plant is arranged such that the hydrate inhibitor is mixed with the liquid phase hydrocarbons after being used to dry the hydrocarbon gas stream.

6. A system according to claim 5, wherein the system is arranged such that the liquid stream is returned from the subsea processing plant to the host.

7. A system according to claim 1, where the host comprises a desiccant regeneration unit, wherein the desiccant separated from the hydrocarbon gas-phase stream is returned to the host, and wherein the desiccant is regenerated by the desiccant regeneration unit.

8. A system according to claim 6, where the host comprises a desiccant regeneration unit, wherein the host is configured to separate the desiccant from the liquid stream, and wherein the desiccant is regenerated by the desiccant regeneration unit.

9. A system according to claim 1, wherein the subsea processing plant is configured to cool the hydrocarbon gas-phase stream and separate condensed liquids from the hydrocarbon gas-phase stream prior to mixing the desiccant with the hydrocarbon gas-phase stream.

10. A subsea method of offshore hydrocarbon processing, comprising:

receiving, in a subsea processing plant, an input hydrocarbon stream from a wellhead;

receiving, in the subsea processing plant via an umbilical, a desiccant from a host at surface level, wherein the desiccant is also a hydrate inhibitor;

separating, in the subsea processing plant, a hydrocarbon gas-phase stream from the input hydrocarbon stream;

treating, in the subsea processing plant, the hydrocarbon gas-phase stream using the desiccant to satisfying a rich gas pipeline transportation specification, wherein the treating comprises co-currently mixing the desiccant with the hydrocarbon gas-phase stream, cooling the mixed desiccant and hydrocarbon gas-phase stream, and separating the desiccant and condensed liquids from the hydrocarbon gas-phase stream; and outputting the hydrocarbon gas-phase from the subsea processing plant to a pipeline.

11. A method according to claim 10, wherein the hydrocarbon gas-phase stream is not output to the host.

12. A method according to claim 10, wherein hydrocarbon gas-phase stream is output from the subsea processing unit to a rich gas pipeline without further processing.

13. A method according to claim 10, wherein the host controls the hydrocarbon dew point and the water dew point of the hydrocarbon gas-phase stream output by the subsea processing plant.

14. A method according to claim 10, wherein the host controls the content of $H_2S$, $CO_2$ and Hg of the hydrocarbon gas-phase stream output by the subsea processing plant.

15. A method according to claim 10, wherein the separating step comprises: separating, in the subsea processing plant, a hydrocarbon gas-phase stream and a hydrocarbon liquid-phase stream from the input hydrocarbon stream.

16. A method according to any claim 15, wherein the desiccant is a hydrate inhibitor having a water content sufficiently low so as to enable the subsea processing plant to dry the hydrocarbon gas stream using the hydrate inhibitor so as to satisfy rich gas pipeline transport specifications.

17. A method according to claim 16, comprising, after treating the hydrocarbon gas-phase stream using the desiccant, mixing the desiccant with the liquid-phase hydrocarbon stream.

18. A method according to claim 17, wherein the liquid-phase hydrocarbon stream is returned from the subsea processing plant to the host.

19. A method according to claim 10, where the host comprises a desiccant regeneration unit, the method further comprising:

returning the desiccant separated from the hydrocarbon gas-phase stream is to the host, and regenerating the desiccant using the desiccant regeneration unit.

20. A method according to claim 18, where the host comprises a desiccant regeneration unit, the method further comprising:

separating the desiccant from the liquid stream at the host, and regenerating the desiccant using the desiccant regeneration unit.

21. A method according to claim 10, further comprising, prior to mixing the desiccant with the hydrocarbon gas-phase stream:

cooling the hydrocarbon gas-phase stream; and separating condensed liquids from the hydrocarbon gas-phase stream.

22. A system for offshore hydrocarbon processing, comprising:

a platform at surface level having a store of desiccant and a desiccant regeneration unit, wherein the desiccant is also a hydrate inhibitor;

a subsea processing plant for producing a hydrocarbon gas stream that meet a rich gas pipeline transportation specification, comprising:

an input conduit for receiving a multi-phase input stream from a wellhead;

a first separator fed by the input conduit for separating a hydrocarbon gas-phase stream from the multi-phase input stream and for outputting the hydrocarbon gas-phase stream to a first intermediate conduit;

a first cooler in the first intermediate conduit for cooling the hydrocarbon gas-phase stream;

a second separator fed by the first intermediate conduit for separating hydrocarbon condensate and liquid water from the hydrocarbon gas phase stream, and for outputting the hydrocarbon gas-phase stream to a second intermediate conduit;

a co-current injector for supplying desiccant to the second intermediate conduit to dry the hydrocarbon gas stream;

a second cooler in the second intermediate conduit downstream of the injector, for cooling the hydrocarbon gas-phase stream; and a third separator fed by the second intermediate conduit for separating the desiccant from the hydrocarbon gas phase stream, and for outputting the hydrocarbon gas-phase stream to a first output conduit and the desiccant to a second output conduit; and a umbilical line adapted to supply desiccant from the store of desiccant of the host to the injector of the subsea processing plant;

wherein desiccant from the second output conduit is returned to the platform where it is regenerated by the desiccant regeneration unit.

23. A system according to claim 22, wherein the first separator is further arranged to output a liquid-phase hydrocarbon stream into the second conduit to be mixed with the desiccant.

* * * * *